US006935320B2

(12) United States Patent
Veinotte

(10) Patent No.: US 6,935,320 B2
(45) Date of Patent: Aug. 30, 2005

(54) APPARATUS AND METHOD FOR EXHAUST GAS FLOW MANAGEMENT OF AN EXHAUST GAS RECIRCULATION SYSTEM

(75) Inventor: Andre Veinotte, Dresden (CA)

(73) Assignee: Siemens VDO Automotive Inc., Chatham (CA)

( * ) Notice: Subject to any disclaimer, the term of this patent is extended or adjusted under 35 U.S.C. 154(b) by 117 days.

(21) Appl. No.: 10/290,497

(22) Filed: Nov. 8, 2002

(65) Prior Publication Data

US 2003/0084887 A1 May 8, 2003

Related U.S. Application Data

(60) Provisional application No. 60/337,782, filed on Nov. 8, 2001.

(51) Int. Cl.[7] ..... F02M 25/07

(52) U.S. Cl. ..... 123/568.18; 123/568.23

(58) Field of Search ..... 123/568.11, 568.18, 123/568.17, 568.21, 568.22, 568.23, 568.24; 251/129.11, 129.08

(56) References Cited

U.S. PATENT DOCUMENTS

| | | | | |
|---|---|---|---|---|
| 3,741,179 | A | 6/1973 | Vartanian | |
| 3,915,134 | A | 10/1975 | Young et al. | |
| 4,094,285 | A | 6/1978 | Oyama et al. | |
| 4,171,689 | A | 10/1979 | Eheim | |
| 4,196,708 | A | 4/1980 | May et al. | |
| 4,196,709 | A | 4/1980 | Toryu et al. | |
| 4,214,562 | A | 7/1980 | Mowbray | |
| 4,222,356 | A * | 9/1980 | Ueda et al. | 123/568.18 |
| 4,230,080 | A | 10/1980 | Stumpp et al. | |
| 4,237,837 | A * | 12/1980 | Toda et al. | 123/568.18 |
| 4,279,235 | A | 7/1981 | Flaig et al. | |
| 4,279,473 | A | 7/1981 | Yamana | |
| 4,280,470 | A | 7/1981 | Ueda | |
| 4,286,567 | A | 9/1981 | Ueda | |
| 4,295,456 | A | 10/1981 | Nomura et al. | |
| 4,329,965 | A | 5/1982 | Ueda et al. | |
| 4,364,369 | A | 12/1982 | Nomura et al. | |
| 4,690,119 | A | 9/1987 | Makino et al. | |
| 5,305,720 | A | 4/1994 | Ando et al. | |
| 5,333,456 | A | 8/1994 | Bollinger | 60/605 |
| 5,785,034 | A | 7/1998 | Moedinger et al. | |
| 5,937,834 | A | 8/1999 | Oto | |
| 5,937,835 | A | 8/1999 | Turner et al. | |
| 6,102,016 | A | 8/2000 | Sitar et al. | |
| 6,135,415 | A | 10/2000 | Kloda et al. | |
| 6,382,195 | B1 | 5/2002 | Green et al. | |
| 6,435,169 | B1 | 8/2002 | Vogt | |
| 6,494,041 | B1 | 12/2002 | Lebold | |
| 2002/0185116 | A1 | 12/2002 | Veinotte | |
| 2003/0111066 | A1 | 6/2003 | Veinotte | |
| 2003/0116146 | A1 | 6/2003 | Fensom et al. | |

FOREIGN PATENT DOCUMENTS

| | | |
|---|---|---|
| EP | 0 840 000 | 5/1998 |
| JP | 11 294267 | 10/1999 |
| JP | 2000 045879 | 2/2000 |

OTHER PUBLICATIONS

U.S. Appl. No. 10/465,867, filed Jun. 20, 2003, Veinotte et al.
U.S. Appl. No. 10/387,439, filed Mar. 14, 2003, Veinotte.
U.S. Appl. No. 10/387,416, filed Mar. 4, 2003, Veinotte.

* cited by examiner

*Primary Examiner*—Mahmoud Gimie
*Assistant Examiner*—Arnold Castro

(57) ABSTRACT

An exhaust gas flow management assembly for an exhaust gas recirculation system including an intake conduit, an exhaust conduit in fluid communication with the intake conduit, and a closing member. The intake conduit includes an inner surface defining a fluid passageway and a recirculation opening in the inner surface. The closing member is movably mounted in the fluid passageway and has a first position where the closing member blocks fluid communication between the intake conduit and the exhaust conduit, and a second position where the closing member extends into the fluid passageway of the intake conduit at an angle relative to a plane including the recirculation opening and opens fluid communication between the intake conduit and the exhaust conduit. When fluid is flowing through the intake conduit and the exhaust conduit, a change in an amount of fluid flowing from the exhaust conduit into the intake conduit is less than 5% of a total amount of fluid flowing in the intake conduit when the angle is less than 10 degrees.

19 Claims, 7 Drawing Sheets

APPARATUS AND METHOD FOR EXHAUST GAS FLOW MANAGEMENT OF AN EXHAUST GAS RECIRCULATION SYSTEM

This application claims priority of copending provisional Application No. 60/337,782 filed on Nov. 8, 2001, which is hereby incorporated by reference.

BACKGROUND OF THE INVENTION

One conventional exhaust gas recirculation (EGR) system for compression ignition internal combustion engines uses two actuators. The first actuator creates a pressure differential in the intake conduit that draws exhaust gas from the exhaust conduit into the intake conduit where it mixes with the intake charge. The second actuator regulates the flow rate of exhaust gas in the exhaust conduit that is drawn into the intake conduit by the first actuator.

Another conventional EGR system employs a single actuator to regulate the flow rate of exhaust gas drawn into the intake conduit from the exhaust conduit. A stationary throttling device is located in the exhaust conduit to promote the flow of exhaust gas into the intake conduit. The negative pressure pre-existing in the intake conduit created during the intake stroke of the engine provides the pressure differential needed to draw the exhaust gas into the intake conduit.

SUMMARY OF THE INVENTION

There is provided An exhaust gas flow management assembly for an exhaust gas recirculation system including an intake conduit, an exhaust conduit in fluid communication with the intake conduit, and a closing member. The intake conduit includes an inner surface defining a fluid passageway and a recirculation opening in the inner surface. The closing member is movably mounted in the fluid passageway and has a first position where the closing member blocks fluid communication between the intake conduit and the exhaust conduit, and a second position where the closing member extends into the fluid passageway of the intake conduit at an angle relative to a plane including the recirculation opening and opens fluid communication between the intake conduit and the exhaust conduit. When fluid is flowing through the intake conduit and the exhaust conduit, a change in an amount of fluid flowing from the exhaust conduit into the intake conduit is less than 5% of a total amount of fluid flowing in the intake conduit when the angle is less than 10 degrees.

There is also provided an a method for managing exhaust gas flow in an exhaust gas recirculation system including an intake conduit having an inner surface defining a fluid passageway and a recirculation opening, an exhaust conduit in fluid communication with the intake conduit, and a closing member movably mounted in the intake conduit. The method includes the steps of moving the closing member between a first position where closing member blocks fluid communication between the intake conduit and the exhaust conduit and a second position where the closing member extends into the fluid passageway of the intake conduit at an angle of relative to a plane including the recirculation opening and opens fluid communication between the intake conduit and the exhaust conduit, and drawing fluid from the exhaust conduit into the fluid passageway such when fluid is flowing through the intake conduit, a change in an amount of the fluid flowing from the exhaust conduit into the intake conduit is less than 5 percent of a total amount of fluid flowing in the intake conduit when the angle is less than 10 degrees.

There is yet also provided an exhaust gas flow management assembly for an exhaust gas recirculation system including an intake conduit an exhaust conduit in fluid communication with the intake conduit, and a closing member. The intake conduit includes an inner surface defining a fluid passageway and a recirculation opening in the inner surface and the intake conduit has a first dimension and a second dimension. The closing member pivotally mounted in the fluid passageway about a pivot axis and includes an operative surface having a perimeter having a third dimension and a fourth dimension. The closing member includes a first position where the closing member blocks fluid communication between the intake conduit and the exhaust conduit, and a second position where the closing member extends into the fluid passageway of the intake conduit at an angle relative to a plane including the recirculation opening and opens fluid communication between the intake conduit and the exhaust conduit. The first dimension and the third dimension are measured in a direction parallel to the pivot axis and the second dimension and the fourth dimension are measured in a direction perpendicular to the pivot axis. The first dimension is greater than the third dimension and the second dimension is greater than the fourth dimension such that fluid flowing from the exhaust passage into the fluid passageway mixes with fluid flowing in the fluid passageway.

BRIEF DESCRIPTION OF THE DRAWINGS

The accompanying drawings, which are incorporated herein and constitute part of this specification, illustrate an embodiment of the invention, and, together with the general description given above and the detailed description given below, serve to explain the features of the invention.

DETAILED DESCRIPTION OF THE PREFERRED EMBODIMENTS

Figure 1:
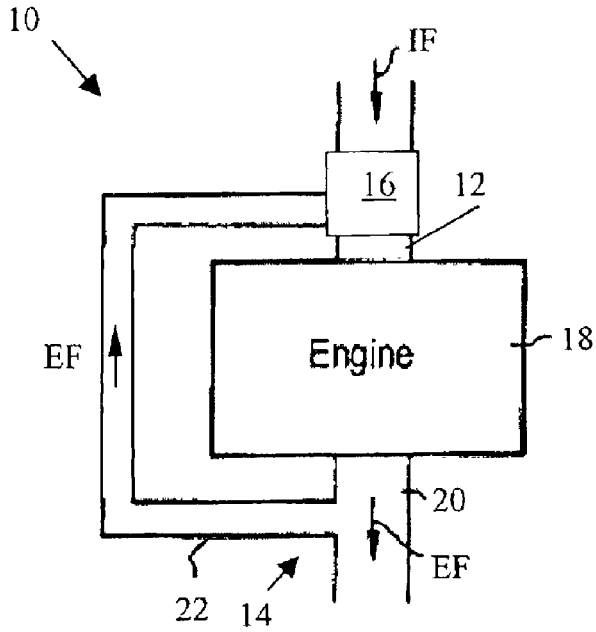
FIG. 1 is a schematic in accordance with an EGR system of an internal combustion engine according to the present invention.
Figure 2:
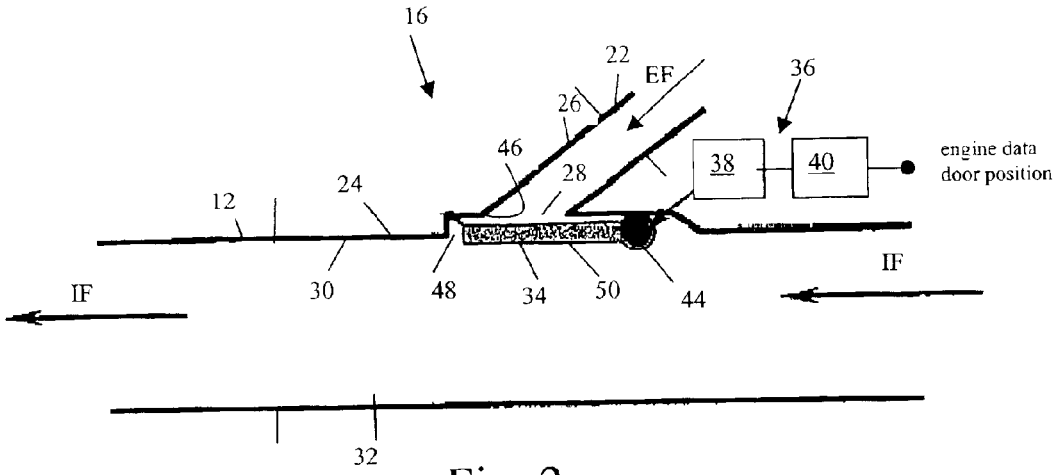
FIG. 2 is a schematic the EGR system of FIG. 1 with the closing member in a first operating condition.
Figure 3:
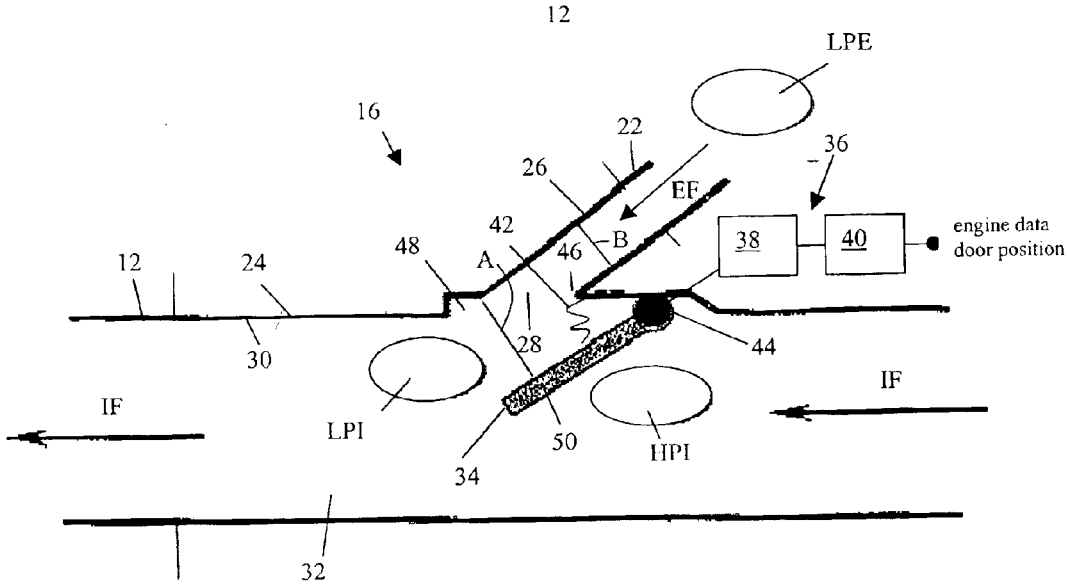
FIG. 3 is a schematic of the EGR system of FIG. 1 with the closing member in a second operating condition.

Referring to FIGS. 1–3, an exhaust gas recirculation (EGR) system 10 includes an intake conduit 12, an exhaust conduit 14 in fluid communication with the intake conduit 12 and a flow control body 16 between the intake conduit 12 and the exhaust conduit 14 to selectively open and close the fluid communication between the intake conduit 12 and the exhaust conduit 14. The intake conduit 12 can be a manifold in fluid communication with a plurality of combustion chambers (not shown) of an internal combustion engine 18. The exhaust conduit 14 can include an exhaust manifold 20 in fluid communication with the combustion chambers of the internal combustion engine 18 and a recirculation conduit 22 in fluid communication with the exhaust manifold 18 and the flow control body 16.

The EGR system 10 can be used with the internal combustion engine 18 to control the emissions of the engine 18 when the amount of exhaust gas flowing in the exhaust conduit 14 enters the intake conduit 12 to mix with an intake charge flowing in the intake conduit 12 on route to a combustion chamber (not shown) of the engine 18. The EGR system 10 can be used with a compression-ignition engine or a spark-ignition engine. Preferably, the EGR system 10 is used in a compression-ignition engine.

Referring to FIGS. 2 and 3, the flow control body 16 includes a manifold conduit 24 in fluid communication with the intake conduit 12 and an inlet conduit 26 in fluid communication with the manifold conduit 24 and the recirculation conduit 22 of the exhaust conduit 14. The manifold conduit 24 includes a recirculation opening 28 and an inner surface 30 defining a fluid passageway 32.

A closing member 34 is movably mounted in the manifold conduit 24. The closing member 34 performs two functions. First, it opens and closes the recirculation opening 28 to selectively open and close the fluid communication between the intake conduit 12 and the exhaust conduit 14. Second, after the closing member 34 opens the fluid communication between the intake conduit 12 and the exhaust conduit 14, the closing member 34 meters the flow rate of exhaust gas that passes from the exhaust conduit 14 to the intake conduit 12.

An actuator assembly 36 includes a servo assembly 38 drivingly coupled to the closing member 34 and a servo controller 40 electrically connected to the servo assembly 38 and a return spring 42 biasing the closing member 34 toward the recirculation opening 28. Preferably, the servo assembly 38 includes an electric motor (not shown) drivingly coupled to a gear train (not shown). The servo controller 40 generates an actuator signal and sends it to the servo assembly 38 to move the closing member 34 from the first position to the second position. Preferably, the servo controller 40 follows a closed-loop algorithm using an engine performance data input and a door position input. Alternatively, the servo controller 40 can follow an open-loop algorithm and additional inputs can be provided to the servo controller 40, such as transmission gear selection and vehicle inclination.

Comparing FIGS. 2 and 3, the closing member 34 is movable between a first position (FIG. 2) where the closing member 34 blocks fluid communication between the intake conduit 12 and the exhaust conduit 14 and a second position (FIG. 3) where the closing member 34 opens fluid communication between the intake conduit 12 and the exhaust conduit 14 and selectively meters the flow rate of exhaust gas passing into the intake conduit 12. The exhaust gas flows through the recirculation conduit 22 in the direction indicated by arrow EF.

FIGS. 2 and 3 schematically represent the closing member 34 as a door pivoting at one end about a rotary shaft 44. Alternatively, the closing member 34 can be displaced in a different manner between the first position and the second position, such as sliding along a linear path. The servo assembly 38 can include any suitable driving mechanism that imparts the chosen pivoting motion, linear motion or other motion on the closing member, such as, an electric or pneumatic motor with or without a gear train, or a solenoid with or without a linkage.

When in the first position, as shown in FIG. 2, the closing member 34 lies adjacent the inner surface 30 of the intake conduit 12 and engages a seat 46 surrounding the recirculation opening 28 to seal the recirculation opening 28 and block the flow of exhaust gas from the recirculation conduit 22 into the intake conduit 12. Preferably, the closing member 34 is positioned in the fluid passageway 32 to minimize disturbance by the closing member 34 of the fluid flowing in the fluid passageway 32 when the closing member 34 is in the first position. As shown in FIGS. 2 and 3, this can be achieved by providing a recess 48 at a location in the inner surface 30 that surrounds the recirculation opening 28. The recess 48 receives the closing member 34 so that the closing member 34 lies approximately coplanar with the inner surface 30 when the closing member 34 is in the first position. Alternatively, a ramp can be providing on the inner surface 30 that diverts the fluid flowing in the fluid passageway 32 over the closing member 34.

When in the second position, as shown in FIG. 3, the closing member 34 is disengaged from the valve seat 46 to open the recirculation opening 28 and permit fluid communication between the recirculation conduit 22 and the intake conduit 12. In the second position, the closing member 34 extends away from recirculation conduit 22 and into the fluid passageway 32 at an opening angle θ measured relative to a plane including the recirculation opening 28. The closing member 34 extends into the fluid passageway 32 to affect the fluid flowing in the intake conduit 12. By extending into the fluid passageway 32, the closing member 22 creates a high pressure region HPI in the intake passage 12 that is upstream of the recirculation opening 28 and an intake low pressure region LPI in the intake conduit 12 that is downstream of and adjacent to the recirculation opening 28. The closing member 34 can vary the pressure value of the intake low pressure region LPI by the amount to which it extends into the fluid passageway 32. As will be explained below, by varying the pressure value of the intake low pressure region LPI, the closing member 34 can meter the volume of exhaust gas entering the intake conduit 12 from the recirculation conduit 22.

During the intake cycle of the engine, the exhaust conduit 14 has a low pressure region LPE that is approximately equal to ambient atmospheric pressure. The closing member 34 further includes an operative surface 50 that creates the intake low pressure region LPI. The extent to which of the operative surface 50 reaches into the fluid passageway 32 controls the value of the intake low pressure region LPI and, thus, the pressure differential between the exhaust low pressure region LPE and the intake low pressure region LPI during the intake cycle of the engine 18. The geometry of the operative surface 50 is, preferably, chosen to provide an optimum value for the intake low pressure region LPI and to promote mixing of the exhaust gas from the exhaust conduit 14 with the fluid flowing in the fluid passageway 32. Preferably, the exhaust gas is mixed with the fluid flowing in the fluid passageway 32 so that each combustion chamber (not shown) of the engine receives at least some of the exhaust gas passing through the recirculation opening 28. The selected geometry must balance with the capacity of the actuator assembly 36 and the effect the operative surface 50 has on flow restriction in the intake conduit 12. The actuator assembly 36 should be of a configuration capable of generating sufficient force to move the closing member 34 between the first position and second position against the resistance created by the fluid flowing in the fluid passageway 32 against the closing member 34 while simultaneously requiring a minimum packaging volume. It is preferred that the restriction of the fluid passageway 32 by the closing member 34 minimally affect the fluid flowing through the fluid passageway 32 to the combustion chamber during the intake cycle and, thus, the power production of the engine 18.

The pressure of the fluid flowing in the intake conduit 12 is approximately equal to ambient atmospheric pressure if the engine is a normally aspirated engine and is greater than ambient atmospheric pressure if the engine is a turbocharged engine. As the closing member 34 moves away from the recirculation conduit 22 and toward the second position (FIG. 3), the intake low pressure region LPI is created adjacent the recirculation opening 28 and has a value slightly less than that of the ambient atmospheric pressure. As the closing member 34 moves farther into the fluid passageway toward the second position, the value of the intake low pressure region LPI approaches vacuum pressure. The pressure differential between the intake low pressure region LPI in the intake conduit 12 and the exhaust low pressure region LPE in the recirculation conduit 22 draws exhaust gas from the exhaust conduit 14 into the intake conduit 12 through the recirculation opening 28. The amount of exhaust gas that enters the intake conduit 12 is proportional to the pressure differential between the intake low pressure region LPI and the exhaust low pressure region LPE. The pressure value of the exhaust low pressure region LPE remains relatively steady over time. Thus, varying the pressure value of the intake low pressure region LPI can vary the flow rate of exhaust gas in the intake conduit 12.

Referring to FIG. 3, the extent to which of the closing member 34 reaches into the fluid passageway 32 controls the value of the intake low pressure region LPI and, thus, the pressure differential between the intake low pressure region LPI and the exhaust low pressure region LPE during the intake cycle of the engine 18. The pressure value of the intake low pressure region LPI, and thus the pressure difference and flow rate of exhaust gas passing through the recirculation opening 28, increases as the closing member 34 reaches farther into the fluid passageway 32 of the manifold conduit 24.

Additionally, the flow cross-sectional area opened to the exhaust gas by the closing member 34 increases as the closing member 34 reaches farther into the fluid passageway. The flow cross-sectional area opened by the closing member 34 is the cross-sectional area extending from the inner surface 30 of the fluid passageway 32 to the free end of the closing member 34 that lies in a plane perpendicular to the flow of exhaust gas in the recirculation conduit 22 indicated by arrow EF in FIG. 3.

The recirculation opening 28 also has a flow cross-sectional area that is bounded by the inner surface of the inlet conduit 26 and lies in a plane perpendicular to the flow of exhaust gas in the recirculation conduit 22 indicated by arrow EF in FIG. 3. The size of the flow cross-sectional area opened by the closing member 34 relative to the flow cross-sectional area at the recirculation opening also affects the amount of exhaust gas entering into the fluid passageway 32. More exhaust gas can pass through recirculation opening 28 as the flow cross-sectional area increases opened by the closing member 34. Therefore, closing member 34 opens fluid communication between the intake conduit 12 and the exhaust conduit 14 and the closing member 34 also meters the amount of exhaust gas passing into the intake conduit 12.

Figure 4:
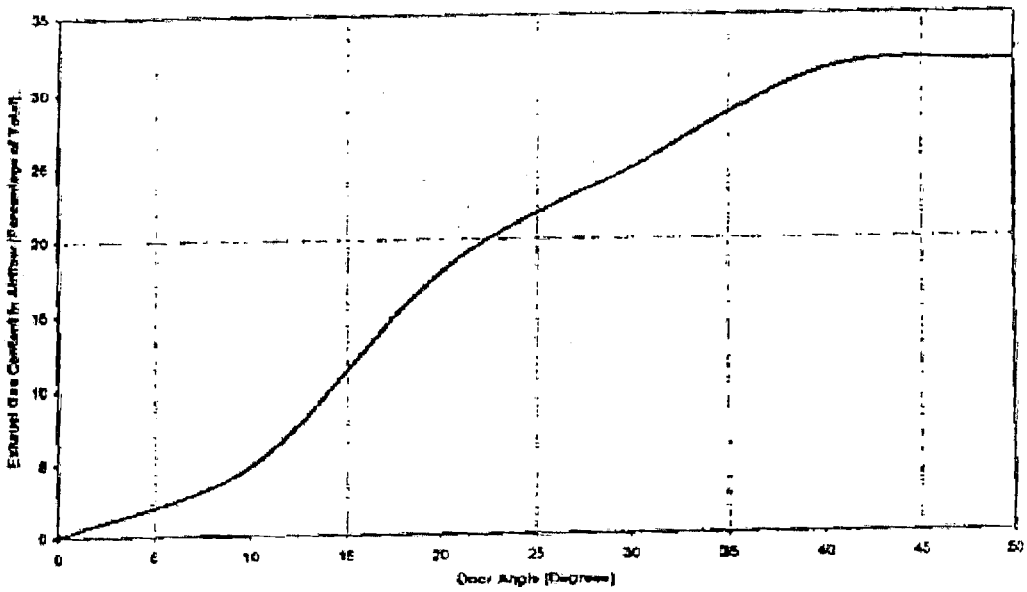
FIG. 4 is a plot of exhaust gas content versus opening angle for the EGR system of FIGS. 1–3.

FIG. 4 is a plot of the amount of exhaust gas entering the fluid passageway 32 from the exhaust conduit 14 versus the opening angle θ. This plot illustrates a non-linear relationship between the amount of exhaust gas entering the fluid passageway 32 (as a percentage of the total amount of fluid flowing through the fluid passageway 32) and the opening angle θ.

In a first region of the plot of FIG. 4 where the opening angle θ is less than 10 degrees, the slope of the curve is small and the amount of exhaust gas entering the fluid passageway 32 is relatively small, i.e., approximately 5 percent of the total amount of fluid flowing through the fluid passageway 32. This permits the closing member 34 to move through a relatively wide range (e.g., 0 to 10 degrees) of opening angles θ with only a small change in the amount of exhaust gas entering the fluid passageway 32.

In this first region, the flow cross-sectional area A (FIG. 3) opened by the closing member 34 is smaller than the flow cross-sectional area B (FIG. 3) of the inlet conduit 26 and the geometry of the interface between the closing member 34 and the seat 46 limits the maximum amount of exhaust gas that can pass through the recirculation opening 28. In the preferred embodiment, the seat 46 tapers from the recirculation opening 28 toward the inlet conduit 26. Further, the closing member 34 reaches into the fluid passageway 32 by a small amount (e.g., less than 25% of total travel of the closing member 34) such that very little, fluid flowing in the fluid passageway 32 separates from the portion of the inner surface 30 proximate the recirculation opening 28. These relationships provide more precise control of exhaust gas recirculation at the low end movement of the closing member 34. This can provide for a minimum disturbance of the fluid flowing in the fluid passageway 32 under large engine loads, yet still can provide a exhaust gas recirculation for decreased emissions.

In a second region of the plot of FIG. 4 where the opening angle θ is at least 35 degrees, the amount of exhaust gas entering the fluid passageway 32 reaches a maximum of approximately 30 percent. In this region, the closing member 34 causes full separation from the portion of the inner surface 30 proximate the recirculation opening of the fluid flowing in the fluid passageway 32. This full separation of the fluid flow provides for the maximum value of the intake low pressure region LPI.

Between the first region and the second region of FIG. 4, the amount of exhaust gas entering the fluid passageway 32 changes dramatically from approximately 5 percent to 30 percent. For example, as illustrated in FIG. 4, the amount of exhaust gas entering into the fluid passageway 32 is approximately 18 percent when the opening angle θ is approximately 20 degrees and approximately 25 percent when the opening angle θ is approximately 30 degrees.

When the closing member 34 is positioned at angle θ that is between the first region and the second region of FIG. 4, only partial separation from the portion of the inner surface 30 proximate the recirculation opening of the fluid flowing in the fluid passageway 32 occurs. Positioning the closing member 34 at an opening angle between approximately 10 degrees and 35 degrees provides a value of the intake low pressure region LPI that is less than the maximum value. The amount of fluid separation increases as opening angle θ of the closing member 34 increases. Thus, the intake low pressure region LPI can be widely increased or decreased by repositioning the closing member 34 at an opening angle θ between approximately 10 degrees and 35 degrees.

FIGS. 5–8 illustrate an embodiment of a modular exhaust gas recirculation assembly 100 according to the EGR system 10 schematically represented in FIGS. 1–3. The modular exhaust gas recirculation assembly 100 integrates a flow control body 116, a closing member 134, and an actuator assembly 136 into a modular unit. The modular exhaust gas recirculation assembly can be configured as a single component for assembly with the engine. This can reduce the part count for the engine. The modular exhaust gas recirculation assembly 100 is assembled to the engine by connecting the modular exhaust gas recirculation assembly 100 to each of the intake conduit and the exhaust conduit and the number of assembly steps can be minimized because the number of components for assembly is reduced.

The flow control body 116 includes a manifold conduit 124 and an inlet conduit 126 in fluid communication with the manifold conduit 124. As described above with reference to FIGS. 1–3, the manifold conduit 124 can be placed in fluid communication with an intake conduit (e.g., at 12 in FIGS. 1–3) and the inlet conduit 126 can be placed in fluid communication with a recirculation conduit of the exhaust conduit (e.g., 22 and 14 in FIGS. 1–3).

Figure 5:
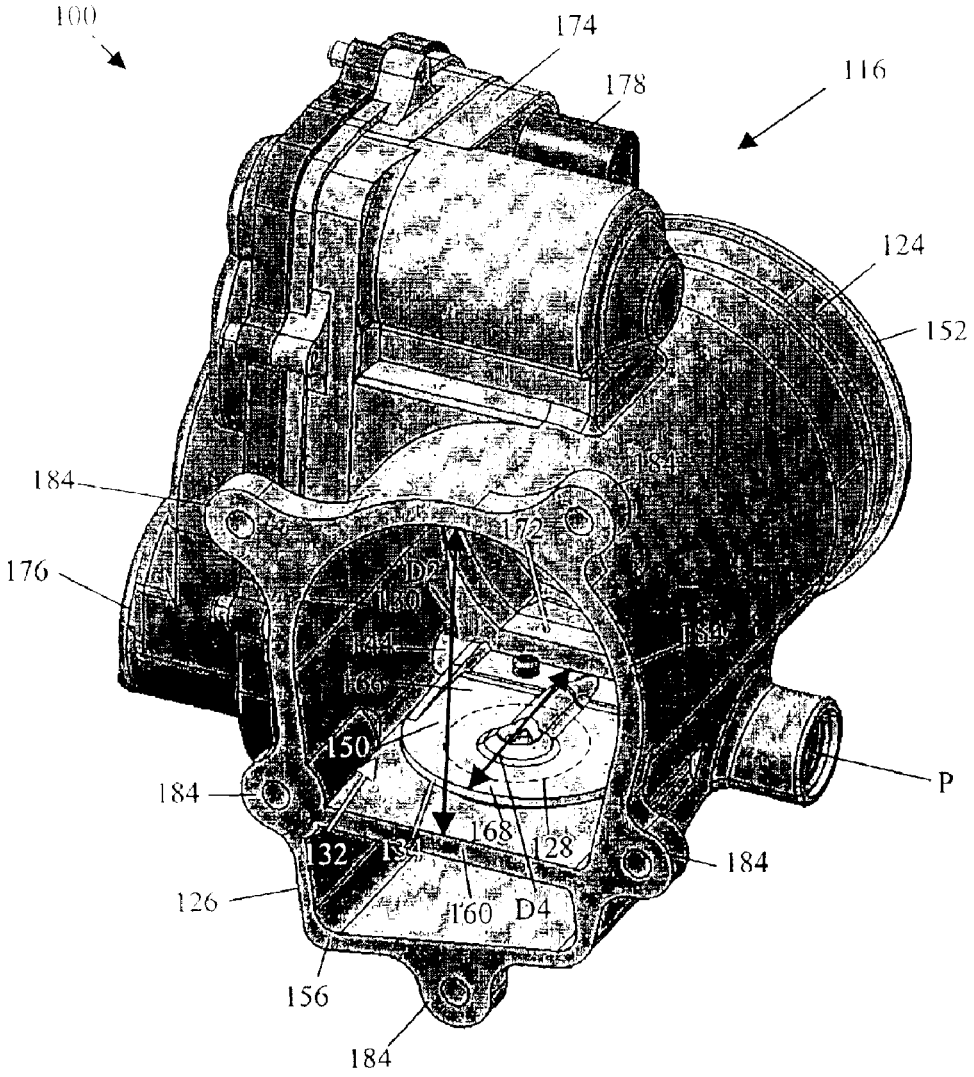
FIG. 5 is a perspective view of an embodiment of an exhaust gas recirculation assembly for an EGR according to the invention.
Figure 6:
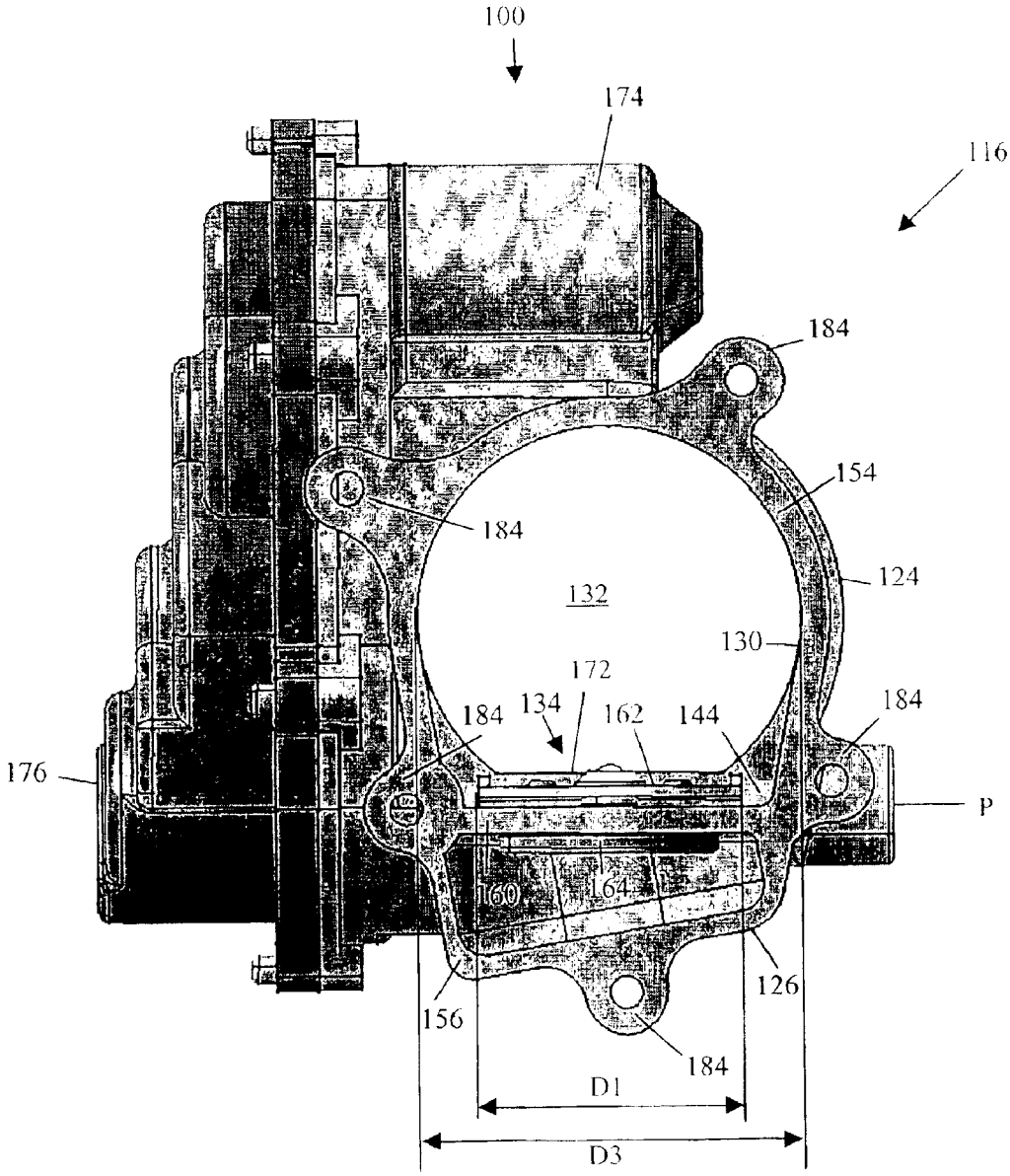
FIG. 6 is an end view of the flow control body according to FIG. 5.
Figure 7:
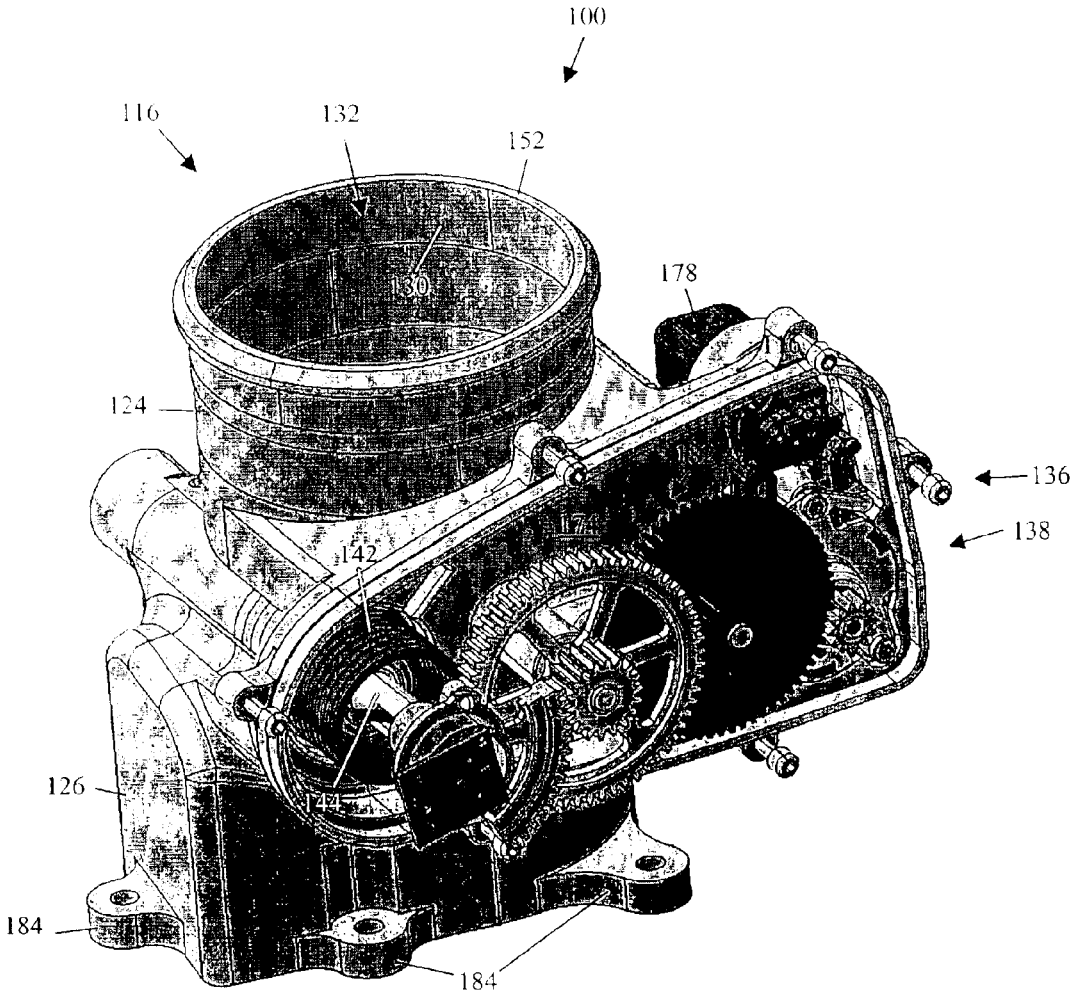
FIG. 7 is another perspective view of the flow control body according to FIG. 5 in a partially assembled state.

The manifold conduit 124 includes a recirculation opening 128 (in phantom in FIG. 5) and an inner surface 130 defining a fluid passageway 132. The recirculation opening 128 is in fluid communication with the inlet conduit 126. The inner surface 130 extends from a first open end 152 to a second open end 154. As shown in FIGS. 5 and 7, the first open end 152 includes a circular cross-sectional shape. FIGS. 5 and 6 show the second open end 154 to include a non-circular cross-sectional shape.

Referring to FIGS. 5 and 6, the inlet conduit 126 extends parallel to the manifold conduit 124 from the recirculation opening 128 to a third open end 156. The third open end 156 is adjacent to and co-planar with the second open end 154 of the manifold conduit 124 and includes a trapezoidal cross-sectional shape.

A common wall 160 forms a portion of the manifold conduit 124 and a portion of the inlet conduit 126. A compact size can be achieved for the flow control body 116 because the inlet conduit 126 extends parallel to the manifold conduit 124 and the inlet conduit 126 and the manifold conduit 124 share the common wall 160. This compact size can improve the packaging efficiency of the EGR system around the engine and within the engine compartment.

Referring to FIG. 5, the common wall 160 can include the recirculation opening 128 (phantom), which is defined by a cylindrical wall or seat (not shown).

A closing member 134 is movably mounted in the manifold conduit 124 between a first position where the closing member 134 seals the recirculation opening 128 and blocks fluid communication between the intake conduit and the exhaust conduit (e.g., 12 and 14 of FIGS. 1–3) and a second position (not shown) where the closing member 134 opens recirculation opening 128 and permits fluid communication between the intake conduit and the exhaust conduit and selectively meters the flow rate exhaust gas passing into the intake conduit. FIGS. 5 and 6 show the closing member 134 in the first position represented schematically in FIG. 2.

Figure 8:
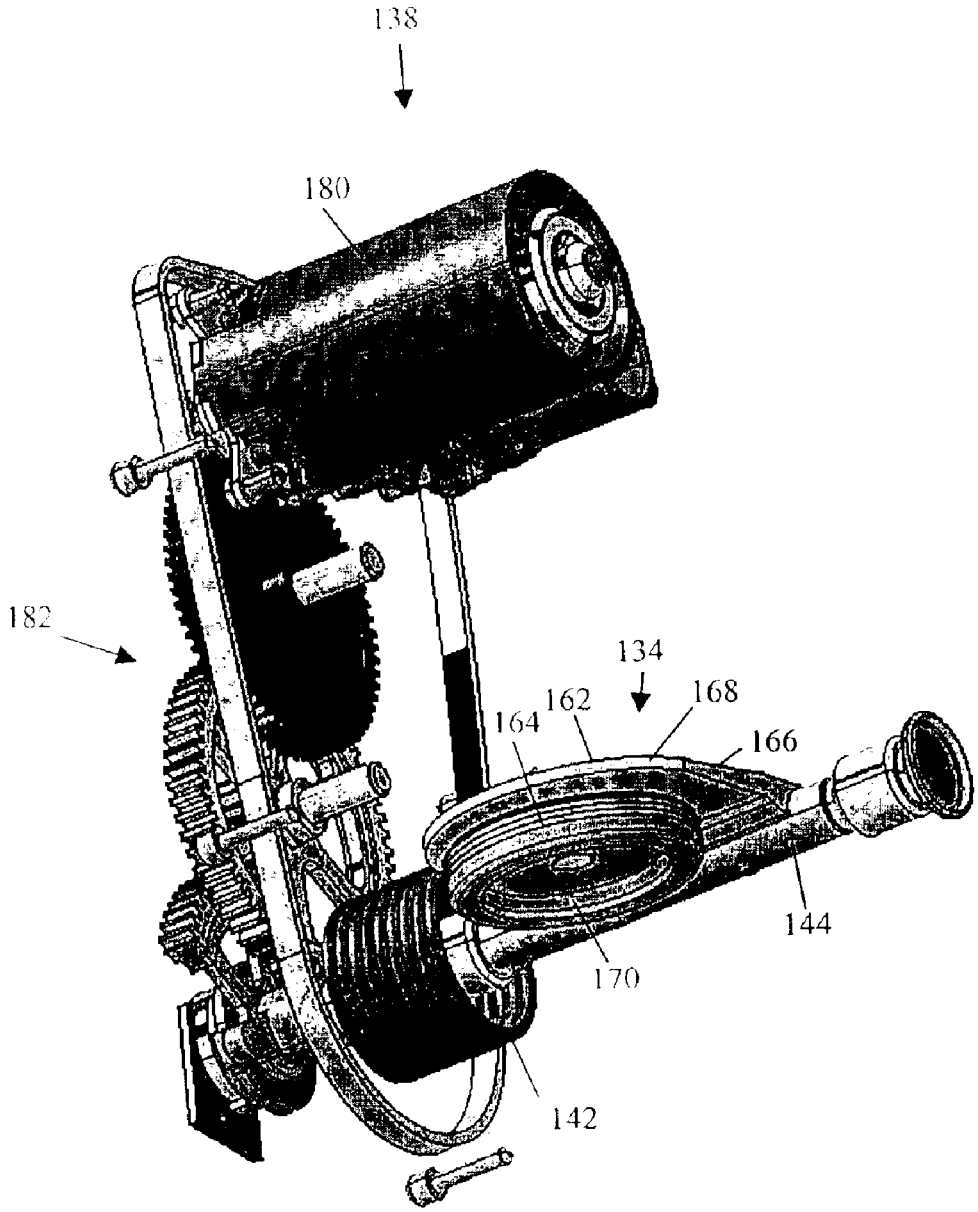
FIG. 8 is a perspective view of the actuator assembly according to FIG. 7.

Referring to FIGS. 5, 6 and 8, the closing member 134 includes a flapper door 162, a seal 164 on the flapper door 162, and a rotary shaft 144 pivotally coupling the flapper door 162 to the flow control body 116. The flapper door 162 has a rectangular base 166 and a semicircular end 168. The rectangular base 166 of the flapper door 162 is fixed to the rotary shaft 144. Referring to FIGS. 6 and 8, a cylindrical projection 170 extends from flapper door 162 adjacent the semicircular end 16. The seal 164 is mounted about the periphery of a cylindrical projection 170.

Referring to FIG. 6, when the flapper door 162 is in the first position, the cylindrical projection 170 extends through the recirculation opening 128 and the seal 164 engages the seat (not shown) to block the recirculation opening 128 and close fluid communication between the intake conduit and the exhaust conduit (see FIGS. 2 and 6). The flapper door 162 pivots about the rotary shaft 144 to the second position (not shown) such that the flapper door 162 extends away from the recirculation opening 128 and into the fluid passageway 132.

Referring to FIGS. 5 and 6, a ramp 172 is located in the fluid passageway 132 of the manifold conduit 124 adjacent the rectangular base 166 of the flapper door 162. The ramp 172 extends from the inner surface 130 of the manifold conduit 124 to a height at least equal to the thickness of the closing member 134. The ramp 172 deflects fluid flowing through the fluid passageway 132 away from the closing member 134 when the closing member is in the first position. This minimizes disturbance by the closing member 134 to the fluid flowing in the fluid passageway 132 when the closing member 134 is in the first position.

Other arrangements are possible to minimize disturbance by the closing member 134 of the fluid flowing through the fluid passageway 132 when the closing member 134 is in the first position, such as, providing a recess in the inner surface 130 to receive the closing member 134, as described with reference to FIGS. 2 and 3.

Referring to FIGS. 5–7, the flow control body 116 also can include an actuator receptacle 174 extending from the manifold conduit 124. The actuator assembly 136 is received in the actuator receptacle 174 and is coupled to the rotary shaft 144. The actuator assembly 136 drives the rotary shaft 144 and moves the closing member 134 between the first position and the second position against the bias of the return spring 142. As shown in FIGS. 5 and 6, an actuator cover 176 extends over the actuator assembly 136 and connects to the actuator receptacle 174 to enclose the actuator assembly 136. Referring to FIGS. 4 and 6, the actuator cover 176 can include an electrical receptacle 178 electrically connected to the servo controller.

Referring to FIGS. 7 and 8, the actuator assembly 136 includes a servo assembly 138 drivingly coupled to the closing member 134 and a servo controller (not shown) electrically connected to the servo assembly 138, and a return spring 142 connected to the closing member 134. The return spring 142 biases the closing member 134 toward the first position. Preferably, the return spring 142 includes a torsion spring coiled about the rotary shaft 144 with one end secured to the rotary shaft 144 and the other end secured to the flow control body 116. Preferably, the servo assembly 138 includes a direct current motor 180 (FIG. 8) driving a gear train 182, with the gear train 182 driving the rotary shaft 144. Alternatively, the servo assembly 138 can include other driving arrangements, such as, an electric torque motor with or without a gear train, a pneumatic actuator, a hydraulic actuator, or a solenoid with or without a linkage.

The servo controller generates an actuator signal and sends it to the servo assembly 138 to move the closing member 134 from the first position to the second position. Preferably, the servo controller follows a closed-loop algorithm using an engine performance data input and a door position input. Alternatively, the servo controller can follow an open-loop algorithm and additional inputs can be provided to the servo controller, such as transmission gear selection and vehicle inclination.

As shown in FIGS. 5–7, it is preferable to space a plurality of bolt flanges 184 about the perimeter of the second open end 154 and the third open end 156. The bolt flanges 158 are adapted to receive bolts for securing the flow control body 116 to the intake conduit and the recirculation conduit. Alternatively, other arrangements can be used to secure the flow control body 116 to the intake conduit and the recirculation conduit, such as, clamps, crimped flanges, solder, and flexible conduit.

Additionally, it is desirable in an EGR system for an engine 18 having a plurality of combustion chambers (not shown) to promote an equal distribution of recirculated exhaust gas into each combustion chamber. If the some of the recirculated exhaust gas does not reach each combustion chamber of the engine 18, then soot can build up in some of the combustion chambers receiving the recirculated exhaust gas and the emissions of the combustion chambers that do not receive recirculated exhaust gas are not improved. This can result in undesirable emissions levels from the engine 18. Accordingly, it is desired to promote a uniform mixing of the exhaust gas from the recirculation conduit 22 with the fluid flowing through the fluid passageway 32 to ensure a desired level of emissions from the engine 18.

The geometry of the operative surface 50 of the closing member 34 relative to the geometry of the fluid passageway 32 can be used to promote uniform mixing of exhaust gas with the fluid flowing through the fluid passageway 32. A preferred embodiment of this feature is illustrated in FIGS. 5 and 6.

Referring to FIGS. 5 and 6, the fluid passageway 132 has a first dimension D1 (FIG. 6) measured in a direction parallel to the pivot axis P and a second dimension D2 (FIG. 5) that is measured perpendicular to the pivot axis P. Likewise, the operative surface 150 of the closing member 134 has a third dimension D3 (FIG. 6) measured in a direction parallel to the pivot axis P and a fourth dimension D4 (FIG. 5) that is measured perpendicular to the pivot axis P.

As illustrated in FIG. 6, the first dimension D1 is less than the third dimension D3. Preferably, the difference between the third dimension D3 and the first dimension D1 is large enough for the closing member 134 to freely pivot between the first position and the second position and small enough to minimize the amount of fluid flowing between the sides of the rectangular base 166 and the inner surface 130 of the fluid passageway 132. The more fluid that flows over the semicircular end 168 of the closing member 134, then greater will be effect of the fluid separation from the inner surface 130, as discussed.

Preferably, the second dimension D2 is set at a value to provide the flow rate necessary to support efficient operation of the engine 18.

Preferably, the fourth dimension D4 is a function of the second dimension D2 and a fifth dimension D5. When the closing member 134 is in the second position that provides the maximum flow rate of exhaust gas (e.g., 30 percent at 35 degrees in the preferred embodiment) into the fluid passageway 132, the closing member 134 must permit an amount of fluid to pass between the closing member 134 and the inner surface 130 to sufficient to prevent choking the engine 18. Preferably about one-half of the fluid passageway 132 remains unobstructed by the closing member 134 when the closing member is in the second position that provides for a maximum flow rate of exhaust gas. That is, the fourth dimension D4 can be characterized by the following equation: $D4=2*D2/\sin(35°)$.

The fifth dimension D5 is the distance from the center of the recirculation opening 128 to the pivot axis P of the closing member 134. Preferably, the value of the fourth dimension D4 is approximately equal to 125% of D5.

This geometric relationship between the closing member 134 and the fluid passageway 132 provides uniform mixing of the exhaust gas with the remaining fluid flowing through the fluid passageway. Uniform mixing of the recirculated exhaust gas promotes the introduction of exhaust gas into each combustion chamber (not shown) of the engine 18 (FIG. 1) and a positive net effect on the emissions from the engine 18.

While the present invention has been disclosed with reference to certain embodiments, numerous modifications, alterations and changes to the described embodiments are possible without departing from the sphere and scope of the present invention, as defined in the appended claims. Accordingly, it is intended that the present invention not be limited to the described embodiments, but that it has the full scope defined by the language of the following claims, and equivalents thereof.

What I claim is:

1. An exhaust gas flow management assembly for an exhaust gas recirculation system comprising:

an intake conduit including an inner surface defining a fluid passageway and a recirculation opening in the inner surface;

an exhaust conduit in fluid communication with the intake conduit; and a closing member movably mounted in the fluid passageway and having:

a first position where the closing member blocks fluid communication between the intake conduit and the exhaust conduit; and a second position where the closing member extends into the fluid passageway of the intake conduit at an angle relative to a plane including the recirculation opening and opens fluid communication between the intake conduit and the exhaust conduit;

wherein when fluid is flowing through the intake conduit and the exhaust conduit, a change in an amount of fluid flowing from the exhaust conduit into the intake conduit is less than 5% of a total amount of fluid flowing in the intake conduit when the angle is less than 10 degrees.

2. The exhaust gas flow management assembly according to claim 1, the amount fluid flowing from the exhaust conduit into the intake conduit is a maximum when the angle is at least 35 degrees.

3. The exhaust gas flow management assembly according to claim 2, wherein the maximum amount is approximately 32% of the total amount of fluid flowing through the intake conduit.

4. The exhaust gas flow management assembly according to claim 2, wherein the a change in an amount of fluid flowing from the exhaust conduit into the intake conduit is between 5% and 25% of a total amount of fluid flowing when the angle is between 10 degrees and 30 degrees.

5. The exhaust gas flow management assembly according to claim 1, wherein the closing member comprises a door pivotally connected to the manifold conduit.

6. The exhaust gas flow management assembly according to claim 5, wherein the angle at which the closing member extends into the fluid passageway is variable between 0 degrees and 40 degrees.

7. The exhaust gas flow management assembly according to claim 1, wherein the intake conduit further comprises a first dimension and a second dimension; and the closing member is pivotally mounted in the fluid passageway and further includes an operative surface having a third dimension and a fourth dimension;

wherein the first dimension and the third dimension are measured in a direction parallel to the pivot axis and the second dimension and the fourth dimension are measured in a direction perpendicular to the pivot axis; and wherein the first dimension is greater than the third dimension and the second dimension is greater than the fourth dimension such that fluid flowing from the exhaust passage into the fluid passageway mixes with fluid flowing in the fluid passageway.

8. The exhaust gas flow management assembly according to claim 7, wherein the intake conduit further comprises a cross-sectional shape; and the perimeter of the operative surface is configured as a shape different from the cross-sectional shape.

9. A method for managing exhaust gas flow in an exhaust gas recirculation system including an intake conduit having an inner surface defining a fluid passageway and a recirculation opening; an exhaust conduit in fluid communication with the intake conduit; and a closing member movably mounted in the intake conduit, the method comprising the steps of:

moving the closing member between a first position where closing member blocks fluid communication between the intake conduit and the exhaust conduit and a second position where the closing member extends into the fluid passageway of the intake conduit at an angle of relative to a plane including the recirculation opening and opens fluid communication between the intake conduit and the exhaust conduit; and drawing fluid from the exhaust conduit into the fluid passageway such when fluid is flowing through the intake conduit, a change in an amount of the fluid flowing from the exhaust conduit into the intake conduit is less than 5 percent of a total amount of fluid flowing in the intake conduit when the angle is less than 10 degrees.

10. The method according to claim 9, wherein the step of moving the closing member further comprises the step of moving the closing member to a third position where the angle is approximately 35 degrees such that a maximum amount of exhaust gas flows from the exhaust conduit into the fluid passageway.

11. The method according to claim 10, further comprising the step of varying the angle between approximately 0 degrees and 40 degrees based on engine operating conditions.

12. The method according to claim 11, wherein the step of varying the angle includes varying the amount of fluid flowing from the exhaust conduit into the intake conduit between approximately 0 percent and 30 percent of a total amount of fluid flowing in the intake conduit.

13. The method according to claim 9, further comprising the steps of:

sensing operating parameters; and varying the angle of the closing member based on sensed operating parameters.

14. The method according to claim 13, wherein the operating parameters include engine data and door position data.

15. An exhaust gas flow management assembly for an exhaust gas recirculation system comprising:

an intake conduit including an inner surface defining a fluid passageway and a recirculation opening in the inner surface, the intake conduit having a first dimension and a second dimension;

an exhaust conduit in fluid communication with the intake conduit; and a closing member pivotally mounted in the fluid passageway about a pivot axis and including:

an operative surface having a perimeter having a third dimension and a fourth dimension;

a first position where the closing member blocks fluid communication between the intake conduit and the exhaust conduit; and a second position where the closing member extends into the fluid passageway of the intake conduit at an angle relative to a plane including the recirculation opening and opens fluid communication between the intake conduit and the exhaust conduit;

wherein the first dimension and the third dimension are measured in a direction parallel to the pivot axis and the second dimension and the fourth dimension are measured in a direction perpendicular to the pivot axis; and wherein the first dimension is greater than the third dimension and the second dimension is greater than the fourth dimension such that fluid flowing from the exhaust passage into the fluid passageway mixes with fluid flowing in the fluid passageway, and the fourth dimension, $D_4$, is defined by the expression, $D_4=2D_2,/\sin\theta$, where $D_2$ is the second dimension and $\theta$ is the angle of the closing member when the closing member is in the second position such that a maximum flow rate of exhaust gas into the fluid passageway occurs.

16. The exhaust gas flow management assembly according to claim 15, wherein the fourth dimension is approximately 25% greater than the distance from the pivot axis to a center of the recirculation opening.

17. The exhaust gas flow management assembly according to claim 15, wherein the intake conduit further comprises a cross-sectional shape; and the perimeter of the operative surface is configured as a shape different from the cross-sectional shape.

18. An exhaust gas flow management assembly for an exhaust gas recirculation system comprising:

an intake conduit including an inner surface defining a fluid passageway and a recirculation opening in the inner surface, the intake conduit having a first dimension and a second dimension;

an exhaust conduit in fluid communication with the intake conduit; and a closing member pivotally mounted in the fluid passageway about a pivot axis and including:

an operative surface having a perimeter having a third dimension and a fourth dimension;

a first position where the closing member blocks fluid communication between the intake conduit and the exhaust conduit; and a second position where the closing member extends into the fluid passageway of the intake conduit at an angle relative to a plane including the recirculation opening and opens fluid communication between the intake conduit and the exhaust conduit;

wherein the first dimension and the third dimension are measured in a direction parallel to the pivot axis and the second dimension and the fourth dimension are measured in a direction perpendicular to the pivot axis; and wherein the first dimension is greater than the third dimension and the second dimension is greater than the fourth dimension such that fluid flowing from the exhaust passage into the fluid passageway mixes with fluid flowing in the fluid passageway, and the fourth dimension is approximately 25% greater than the distance from the pivot axis to a center of the recirculation opening.

19. The exhaust gas flow management assembly according to claim 18, wherein the intake conduit further comprises a cross-sectional shape; and the perimeter of the operative surface is configured as a shape different from the cross-sectional shape.

* * * * *